US009108429B2

(12) United States Patent
Chiba

(10) Patent No.: US 9,108,429 B2
(45) Date of Patent: Aug. 18, 2015

(54) METHOD OF CONTROLLING PRINTER AND PRINTER

(71) Applicant: FUJITSU COMPONENT LIMITED, Tokyo (JP)

(72) Inventor: Masafumi Chiba, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/569,874

(22) Filed: Dec. 15, 2014

(65) Prior Publication Data

US 2015/0191026 A1 Jul. 9, 2015

(30) Foreign Application Priority Data

Jan. 8, 2014 (JP) ..... 2014-001915

(51) Int. Cl.
*B41J 2/35* (2006.01)
*B41J 2/355* (2006.01)

(52) U.S. Cl.
CPC ..... *B41J 2/355* (2013.01)

(58) Field of Classification Search
USPC ..... 347/5, 14, 19, 57, 180, 181, 190–192, 347/195, 211
See application file for complete search history.

(56) References Cited

U.S. PATENT DOCUMENTS 5,760,799 A * 6/1998 Inui et al. ..... 347/14
6,095,700 A 8/2000 Negishi et al.
2006/0164446 A1 7/2006 Beak
2008/0079764 A1* 4/2008 Haflinger ..... 347/19
2011/0242254 A1* 10/2011 Gu et al. ..... 347/192
2013/0235098 A1* 9/2013 Umeda ..... 347/5

FOREIGN PATENT DOCUMENTS

| | | |
|---|---|---|
| EP | 0931665 | 7/1999 |
| JP | S63-060761 | 3/1988 |
| JP | H10-250130 | 9/1998 |
| JP | 2004-209739 | 7/2004 |
| JP | 2004-210444 | 7/2004 |
| JP | 2008-030253 | 2/2008 |

OTHER PUBLICATIONS

Extended European Search Report mailed on Jun. 12, 2015 issued with respect to the corresponding European Patent Application No. 14198644.8.

* cited by examiner

*Primary Examiner* — Kristal Feggins
(74) *Attorney, Agent, or Firm* — IPUSA, PLLC

(57) ABSTRACT

A method of controlling a printer includes measuring a first voltage value of a power supply of the printer before energizing heat generating elements of a print head of the printer. The method also includes calculating, by a controller of the printer, the number of heat generating elements that are simultaneously energizable based on the measured first voltage value of the power supply, an end voltage value of the power supply, an internal resistance value of the power supply, a resistance value of each of the heat generating elements, and a current value of an electric current flowing through a motor of the printer for conveying recording paper. The method further includes performing printing on the recording paper by the print head using the heat generating elements of the calculated number.

8 Claims, 6 Drawing Sheets

METHOD OF CONTROLLING PRINTER AND PRINTER

CROSS-REFERENCE TO RELATED APPLICATION

The present application is based upon and claims the benefit of priority of Japanese Patent Application No. 2014-001915, filed on Jan. 8, 2014, the entire contents of which are incorporated herein by reference.

BACKGROUND OF THE INVENTION

1. Field of the Invention

The present invention relates to methods of controlling printers and to printers.

2. Description of the Related Art

Printers that output receipts are widely used for shop registers and automated teller machines (ATMs) or cash dispensers (CDs) in banks. In such printers that output receipts, printing is performed on thermal paper serving as recording paper by a thermal head while conveying the recording paper, and after conveying the recording paper a predetermined length, the recording paper is cut by a cutter to the predetermined length. Printers may include, for example, a printer body part and a lid part rotatably supported on the printer body part. It is possible to provide a roll of recording paper in the printer body part by opening the lid part. In this case, for example, a thermal head is provided in the printer body part and a platen roller is provided in the lid part, so that the recording paper is held between the thermal head and the platen roller by closing the lid part. Printing is performed on the recording paper by the thermal head with the recording paper thus being held between the thermal head and the platen roller.

Printers using a thermal head include mobile printers that are small in size and easy to carry. Such mobile printers are used to, for example, issue tickets and receipts, and are commonly driven by batteries in view of increased portability. Examples of batteries used in mobile printers include lithium-ion batteries.

Reference may be made to, for example, Japanese Patent Application Nos. 10-250130, 2004-210444, and 2008-30253 for related art.

SUMMARY OF THE INVENTION

According to an aspect of the present invention, a method of controlling a printer includes measuring a first voltage value of a power supply of the printer before energizing a plurality of heat generating elements of a print head of the printer. The method also includes calculating, by a controller of the printer, a number of heat generating elements that are simultaneously energizable based on the measured first voltage value of the power supply, an end voltage value of the power supply, an internal resistance value of the power supply, a resistance value of each of the heat generating elements, and a current value of an electric current flowing through a motor of the printer for conveying recording paper. The method further includes performing printing on the recording paper by the print head using the heat generating elements of the calculated number.

According to an aspect of the present invention, a method of controlling a printer includes measuring a voltage value of a power supply of the printer before energizing a plurality of heat generating elements of a print head of the printer, measuring a first voltage value of the power supply at a time when a first number of heat generating elements are energized, measuring a second voltage value of the power supply at a time when a second number of heat generating elements are energized, the second number being different from the first number. The method also includes calculating, by a controller of the printer, one of an internal resistance value of the power supply and a resistance value of each of the heat generating elements from the measured voltage value, the measured first voltage value, the first number, the measured second voltage value, the second number, and the other of the internal resistance value and the resistance value.

According to an aspect of the present invention, a printer includes a print head that performs printing on recording paper and includes a plurality of heat generating elements. The printer also includes a motor for conveying the recording paper, a control part that controls the print head and the conveyance motor, and a voltage measurement part that measures a voltage of a power supply that supplies electric power. The voltage measurement part measures a voltage value of the power supply before energizing the heat generating elements, and the control part is configured to calculate a number of heat generating elements that are simultaneously energizable based on the measured voltage value of the power supply, an end voltage value of the power supply, an internal resistance value of the power supply, a resistance value of each of the heat generating elements, and a current value of an electric current flowing through the motor. The print head performs the printing on the recording paper using the heat generating elements of the calculated number.

DESCRIPTION OF THE EMBODIMENTS

Figure 1:
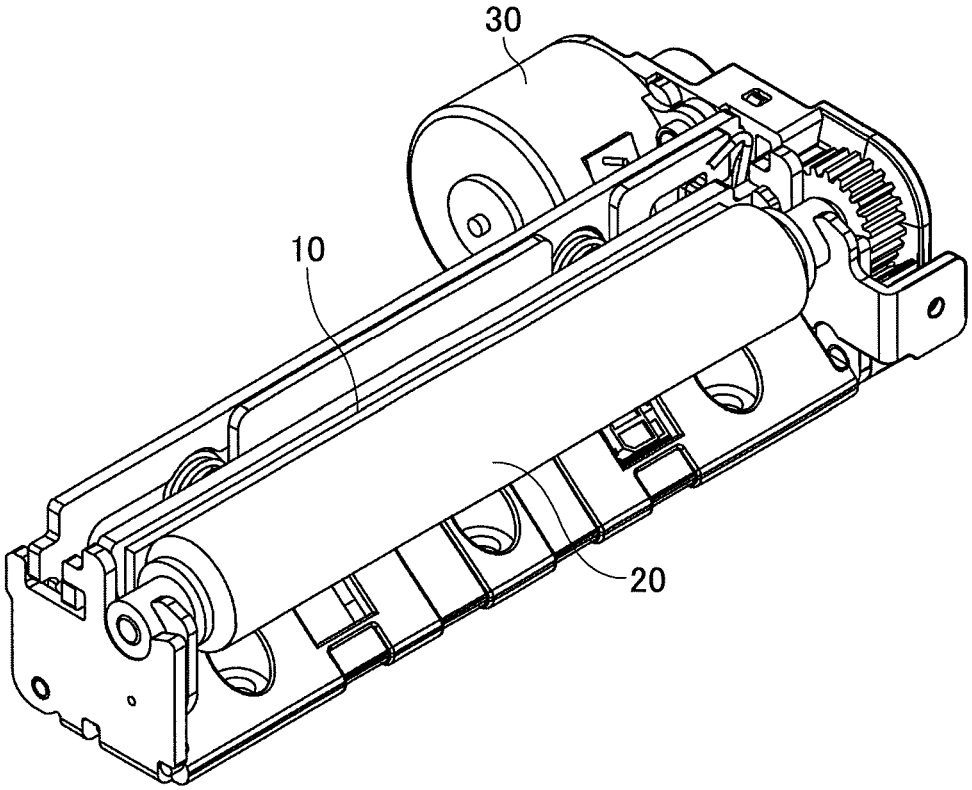
FIG. 1 is a perspective view of an exterior of a printer according to an embodiment.

One or more embodiments of the present invention are described below with reference to the accompanying drawings. In the following description, the same elements are referred to by the same reference numerals and are not repeatedly described.

Figure 2:
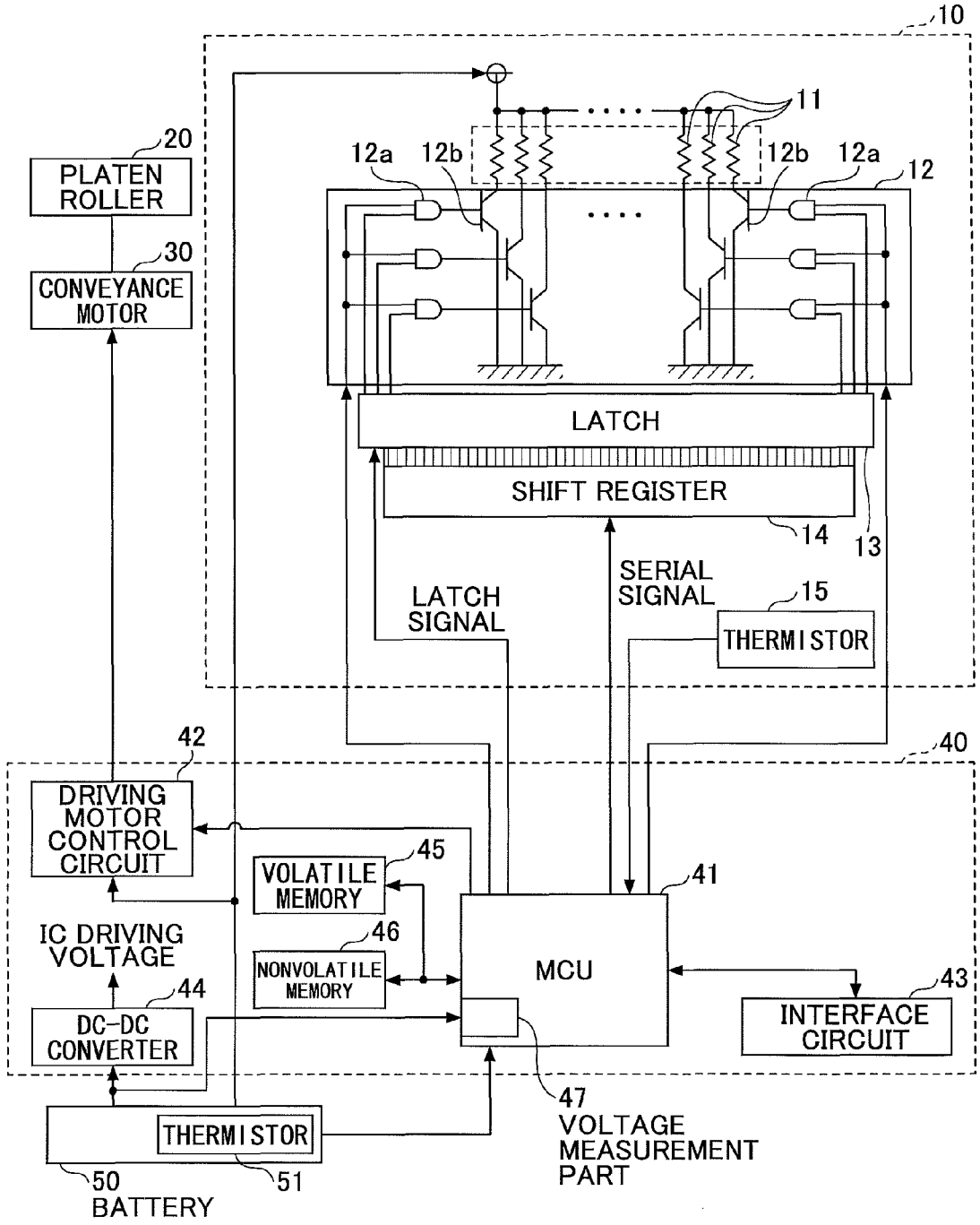
FIG. 2 is a diagram illustrating a configuration of the printer according to the embodiment.

A printer according to an embodiment is described with reference to FIGS. 1 and 2. FIG. 1 is a perspective view of an exterior of the printer of this embodiment. FIG. 2 is a diagram illustrating a configuration of the printer of this embodiment. The printer of this embodiment includes a thermal head 10 serving as a print head, a platen roller 20, a conveyance motor 30, a circuit part 40, and a battery 50 serving as a power supply.

Referring to FIG. 2, heat generating elements 11 for performing printing are arranged in the thermal head 10. The thermal head 10 is provided with a heat generating element driving circuit 12, a latch 13, a shift register 14, and a thermistor 15. The heat generating element driving circuit 12 includes AND circuits 12*a* and transistors 12*b*. The output of each AND circuit 12*a* is connected to the corresponding heat generating element 11 through the corresponding transistor 12*b*. One of the inputs of each AND circuit 12*a* is connected to the MCU 41, and another of the inputs of each AND circuit 12*a* is connected to the latch 13. When both inputs are high, each AND circuit 12*a* outputs a signal to turn on the transistor 12*b* so as to cause an electric current to flow through the corresponding heat generating element 11 so that the heat generating element 11 generates heat. The shift register 14 is connected to the latch 13. The thermistor 15 is provided for measuring the temperature of the thermal head 10. The latch 13 and the shift register 14 are attached to the thermal head 10 as an integrated circuit (IC).

The circuit part 40 includes a micro control unit (MCU) 41 serving as a control part, a driving motor control circuit 42, an interface circuit 43, a DC-DC converter 44, a volatile memory 45, and a nonvolatile memory 46. The MCU 41 includes an AD converter serving as a voltage measurement part 47 that measures the voltage of the battery 50. The voltage measurement part 47 detects the voltage as an analog signal and converts the analog signal into a digital signal. The voltage measurement part 47 may be provided outside the MCU 41. The battery 50 is provided with a thermistor 51 for measuring the temperature of the battery 50.

The printer of this embodiment is battery-driven. The battery 50 supplies electric power to the MCU 41, the thermal head 10, and the DC-DC converter 44.

A latch signal is input from the MCU 41 to the latch 13. A serial signal is input from the MCU 41 to the shift register 14 in order to select one or more of the heat generating elements 11 through which an electric current flows. For example, with respect to each heat generating element 11, "1" is set in the shift register 14 in the case of causing an electric current to flow through the heat generating element 11, and "0" is set in the shift register 14 in the case of not causing an electric current to flow through the heat generating element 11. Data is transferred as the serial signal by, for example, serial communications synchronizing with a clock signal. The serial signal input to the shift register 14 is converted into a parallel signal in the shift register 14, and the parallel signal is determined by the latch signal input to the latch 13. That is, the data is transferred from the shift register 14 to the latch 13, and the data is transferred from the latch 13 to each AND circuit 12*a* in response to the input of the latch signal. Thereafter, printing is performed by driving the heat generating element driving circuit 12 to cause an electric current to flow through the selected one or more of the heat generating elements 11 with respect to which a signal input to the corresponding AND circuit 12*a* from the latch 13 is "1", so that the selected one or more of the heat generating elements 11 generate heat. Printing by the thermal head 10 may be performed on recording paper using an ink ribbon or on thermal paper employed as recording paper.

Recording paper is conveyed by rotating the platen roller 20 by the conveyance motor 30. For example, printing is performed on recording paper held between the thermal head 10 and the platen roller 20, and the recording paper is conveyed by the rotation of the platen roller 20.

The MCU 41 controls the printer, and performs various kinds of operations. The MCU 41 has functions such as the function of inputting and outputting serial data, a timer function using a built-in clock, and the function of reading data from and writing data to the volatile memory 45 and the nonvolatile memory 46. Furthermore, the MCU 41 controls the rotation of the conveyance motor 30 by way of the driving motor control circuit 42. Recording paper is conveyed by rotating the platen roller 20 by rotating the conveyance motor 30.

The DC-DC converter 44 connected to the battery 50 converts the voltage of the battery 50 into an IC driving voltage for driving, for example, the volatile memory 45 of the circuit part 40 and the latch 13 and the shift register 14 of the thermal head 10.

The resistance values of the thermistor 15 provided in the thermal head 10 and the thermistor 51 connected to the battery 50 change depending on temperature. Therefore, a fixed resistor (not illustrated) may be connected to the thermistor 15 so as to divide the voltage, and the resistance value of the thermistor 15 may be measured by measuring a fractional voltage obtained by dividing the voltage between the thermistor 15 and the fixed resistor by the voltage measurement part 47 provided in the MCU 41. Likewise, a fixed resistor may be connected to the thermistor 51 so as to divide the voltage, and the resistance value of the thermistor 51 may be measured by measuring a fractional voltage obtained by dividing the voltage between the thermistor 51 and the fixed resistor by the voltage measurement part 47 provided in the MCU 41. As a result, it is possible to measure temperature at positions where the thermistor 15 and the thermistor 51 are provided.

Information to be printed by the printer is transmitted from a host apparatus (not illustrated), and the information transmitted from the host apparatus is received by the interface circuit 43 and transferred to the MCU 41. The information transferred to the MCU 41 is transferred to and stored in the volatile memory 45. The information may include graphic data for printing and a command, and a process is executed based on the information.

Figure 3:
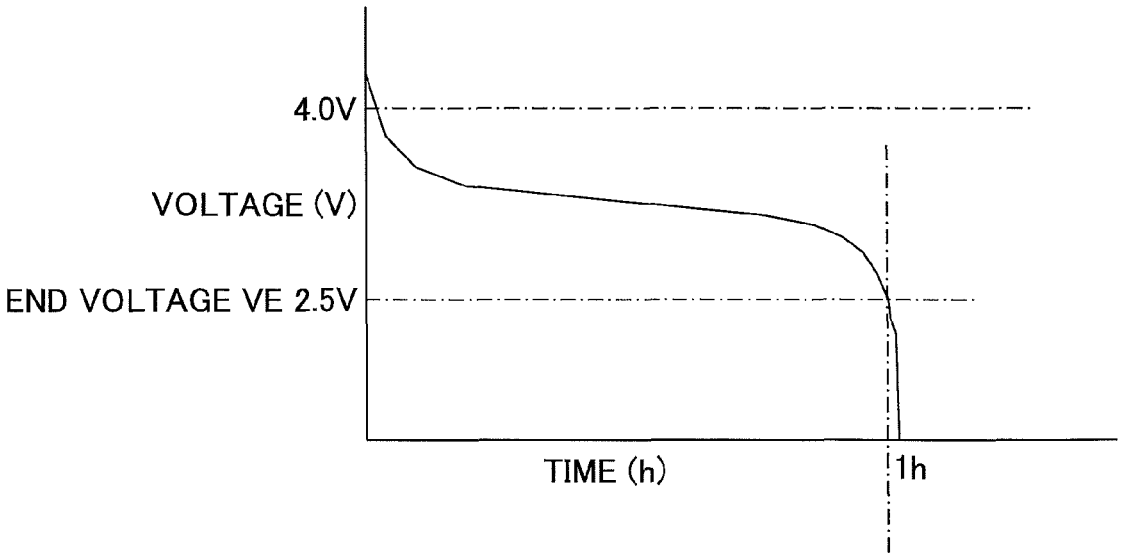
FIG. 3 is a discharge characteristic diagram of a battery.

Next, the battery 50 used in the printer is described. The battery 50 is a rechargeable battery such as a lithium-ion battery. The voltage of the battery 50 decreases in proportion to the time of use of the battery 50 as illustrated in FIG. 3. For example, in the case where the initial voltage value of the battery 50 is higher than or equal to 4.0 V and an end voltage value VE of the battery 50 at which the battery 50 is not usable in the printer is 2.5 V and if the discharge capacity of the battery 50 is 1.0 C and the ambient temperature is 20° C., the time before the voltage of the battery 50 reaches the end voltage value VE is approximately 1 hour.

Next, a method of controlling a printer according to this embodiment is described. According to this embodiment, the number of heat generating elements 11 that may be simultaneously energized (supplied with an electric current) in the thermal head 10 in the printer is calculated, and printing is performed by the thermal head 10 using the calculated number of the heat generating elements 11.

Figure 4:
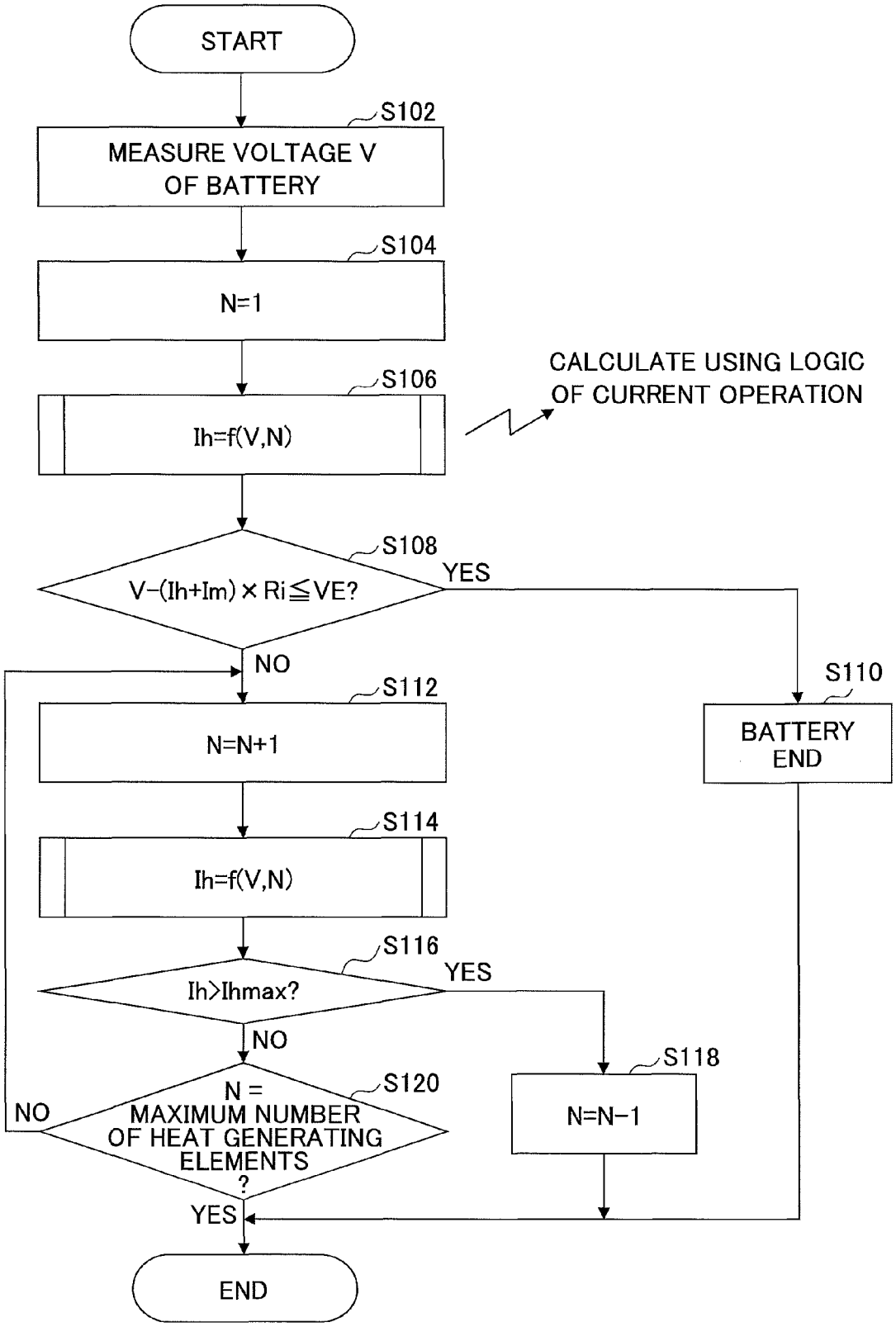
FIG. 4 is a flowchart of a method of controlling a printer according to the embodiment.

FIG. 4 is a flowchart illustrating a method of calculating the number of heat generating elements 11 that may be simultaneously energized in the thermal head 10 according to the method of controlling a printer of this embodiment.

First, at step S102, a voltage value V of the battery 50 is measured by the voltage measurement part 47. The voltage value V measured at step S102 is the voltage value of the battery 50 measured before energizing components to be energized in the printer including the heat generating elements 11 of the thermal head 10. Hereinafter, such components to be energized are collectively referred to as "Heat Generating Elements." In the following, the expression "N Heat Generating Elements" means N heat generating elements 11 and the other components to be energized.

Next, at step S104, the number of dots (the number of heat generating elements 11 that may be simultaneously energized) N is set to 1.

Next, at step S106, an electric current Ih that flows through the heat generating element 11 is calculated by executing an operational subroutine of Ih=f(V,N).

Next, at step S108, it is determined whether Eq. (1) below is satisfied:

$$V-(Ih+Im)\times Ri\leq VE, \quad (1)$$

where Im is the value of an electric current that flows through the conveyance motor 30, and Ri is the internal resistance value of the battery 50.

If Eq. (1) is satisfied (YES at step S108), the process proceeds to step S110. If Eq. (1) is not satisfied (NO at step S108), the process proceeds to step S112.

At step S110, the end of the battery 50 is detected, and the process ends.

At step S112, N is incremented by one.

Next, at step S114, the electric current Ih that flows through the heat generating elements 11 by executing the operational subroutine of Ih=f(V,N).

Next, at step S116, it is determined whether Ih is greater than Ihmax (the maximum value of Ih). If Ih is greater than Ihmax (YES at step S116), the process proceeds to step S118. If Ih is less than or equal to Ihmax (NO at step S116), the process proceeds to step S120.

At step S118, the end of the battery 50 is detected, and N is decremented by one. Then, the process ends.

At step S120, it is determined whether N is the maximum number of the heat generating elements 11 that can be simultaneously energized. If N is the maximum number (YES at step S120), the process ends. If N is not the maximum number (NO at step S120), the process returns to step S112.

Printing is performed with N determined in step S118 or S120 being set as the number of heat generating elements 11 that can be simultaneously energized.

Figure 5:
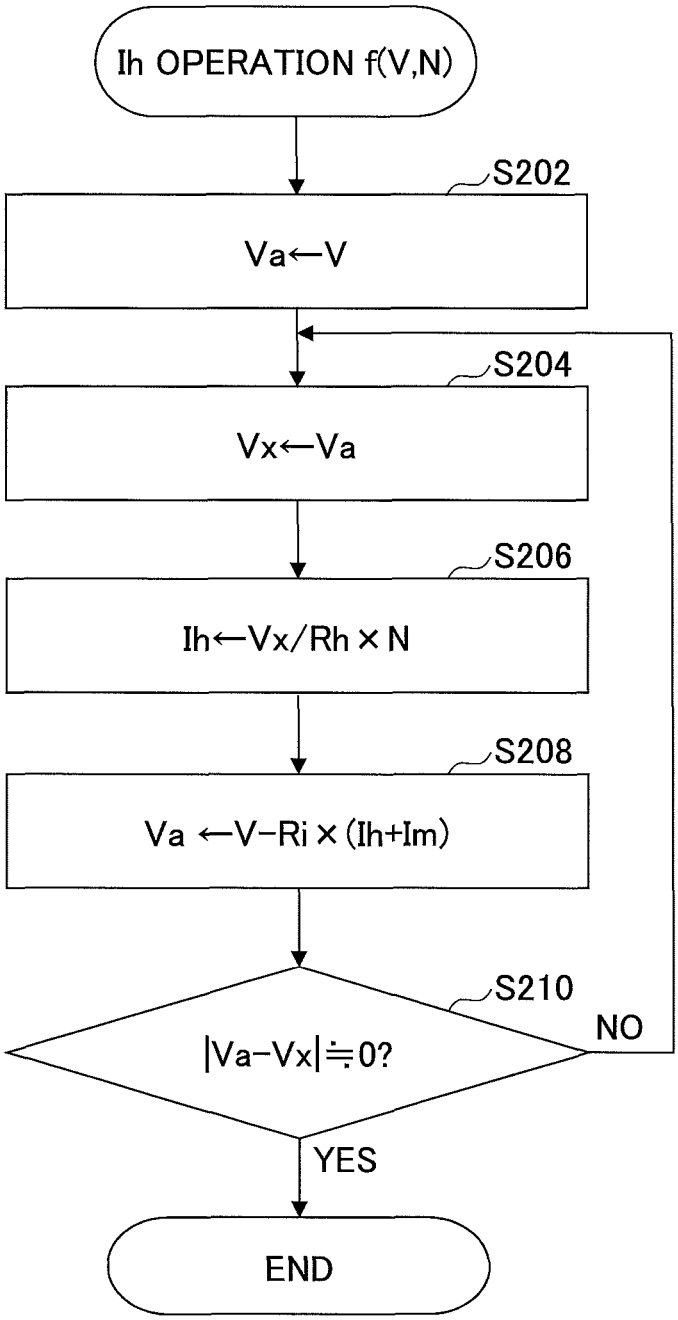
FIG. 5 is another flowchart of the method of controlling a printer according to the embodiment.

Next, the operational subroutine of Ih=f(V,N) at steps S106 and S114 of FIG. 4 is described with reference to FIG. 5.

Figure 6:
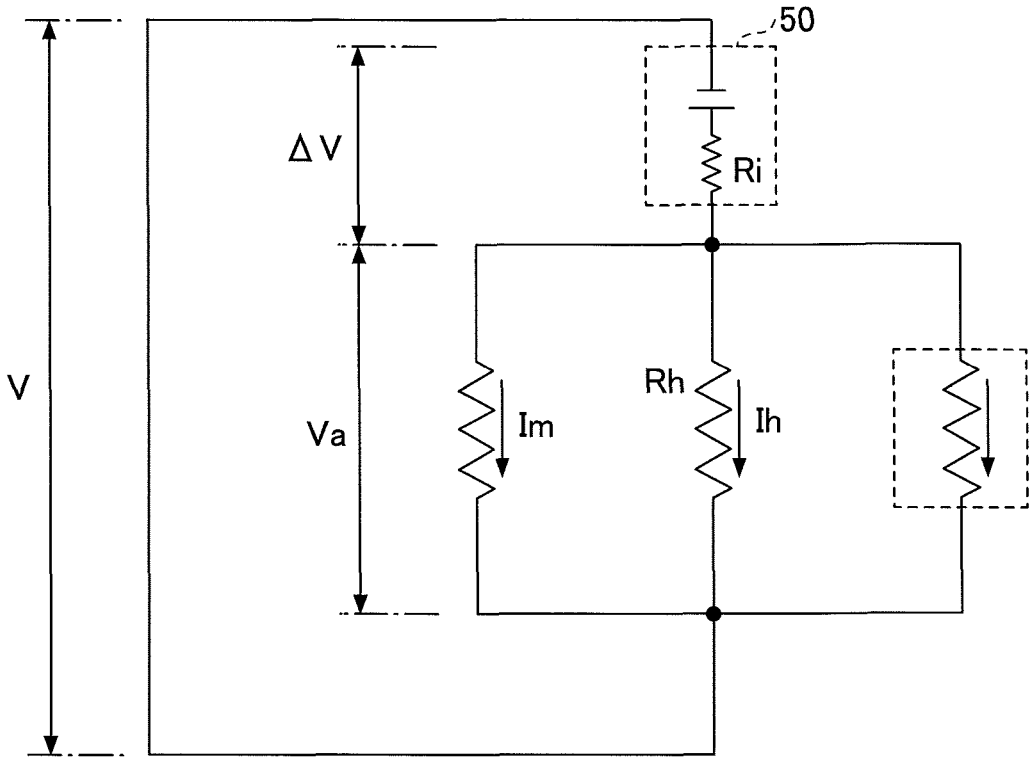
FIG. 6 is a diagram illustrating the voltage, electric current, and electrical resistance of the printer according to the embodiment.

First, at step S202, the voltage value V of the battery 50 is set as a voltage value Va. As illustrated in FIG. 6, the voltage value Va is a voltage value after a voltage drop ΔV in the battery 50 due to its internal resistance (Va=V−ΔV).

Next, at step S204, the voltage value Va after the voltage drop ΔV is set as Vx. Thus, when the process of step S204 is executed for the first time in the flow of FIG. 5, V is set as Vx (Vx=V).

Next, at step S206, Ih is calculated based on Eq. (2) as follows:

$$Ih=Vx/(Rh\times N), \quad (2)$$

where Rh is the resistance value of a single heat generating element 11.

Next, at step S208, the voltage value Va after the voltage drop ΔV is calculated based on Eq. (3) as follow:

$$Va=V-Ri\times(Ih+Im). \quad (3)$$

Here, Ri×(Ih+Im) is the voltage drop ΔV in the battery 50.

Next, at step S210, it is determined whether Eq. (4) below is satisfied:

$$|Va-Vx|\approx 0, \quad (4)$$

where Va is the voltage value Va after the voltage drop ΔV calculated based on Eq. (3) at step S208.

If Eq. (4) is satisfied (YES at step S210), this subroutine ends. If Eq. (4) is not satisfied (NO at step S210), the process returns to step S204.

The relations of V, Va, ΔV, Im, Rh, and Ih are illustrated in FIG. 6. In FIG. 6, the resistance illustrated in association with Im is the internal resistance of the conveyance motor 30. Furthermore, a broken-line rectangle indicates another electric current flowing in the printer. Normally, such an electric current flows constantly and is small in magnitude, and is therefore not considered in the operation subroutine of FIG. 5.

Next, a method of calculating the internal resistance value Ri of the battery 50, the resistance value Rh of a single heat generating element 11, and the current value Im of an electric current flowing through the conveyance motor 30 from a difference ΔV' between the voltage value V of the battery 50 before energizing N Heat Generating Elements measured by the voltage measurement part 47 and a voltage value Vt of the battery 50 at the time when N Heat Generating Elements are energized. To be more specific, from Eq. (5) below, Eq. (6) below is derived as follows:

$$Vt=V-(Ih+Im)\times Ri, \quad (5)$$

$$\Delta V'=V-Vt=(Ih+Im)\times Ri=\{(Vt\times N)/Rh+Im\}\times Ri. \quad (6)$$

In Eq. (6), ΔV' and Vt are measured values, and N is a value that may be preset. Accordingly, by determining that two of Rh, Im, and Ri be constants, it is possible to calculate the value of the remaining one of Rh, Im, and Ri.

Specifically, by determining that the internal resistance value Ri of the battery 50 and the resistance value Rh of a single heat generating element 11 be constants in Eq. (6), it is possible to calculate the current value Im of an electric current flowing through the conveyance motor 30.

Furthermore, by determining that the resistance value Rh of a single heat generating element 11 and the current value Im of an electric current flowing through the conveyance motor 30 be constants in Eq. (6), it is possible to calculate the internal resistance value Ri of the battery 50.

Furthermore, by determining that the internal resistance value Ri of the battery 50 and the current value Im of an electric current flowing through the conveyance motor 30 be constants in Eq. (6), it is possible to calculate the resistance value Rh of a single heat generating element 11.

Furthermore, letting the difference between the voltage value V of the battery 50 before energizing the Heat Generating Elements measured by the voltage measurement part 47 and a voltage value $Vt_1$ of the battery 50 at the time when $N_1$ Heat Generating Elements are energized be $\Delta V_1$ and letting the difference between the voltage value V of the battery 50 before energizing the Heat Generating Elements measured by the voltage measurement part 47 and a voltage value $Vt_2$ of the battery 50 at the time when $N_2$ Heat Generating Elements are energized be $\Delta V_2$, $\Delta V_1$ is expressed by Eq. (7) below and $\Delta V_2$ is expressed by Eq. (8) below:

$$\Delta V_1=\{(Vt_1\times N_1)/Rh+Im\}\times Ri, \quad (7)$$

$$\Delta V_2=\{(Vt_2\times N_2)/Rh+Im\}\times Ri. \quad (8)$$

Accordingly, from Eq. (7) and Eq. (8), Eq. (9) and Eq. (10) below are derived as follows:

$$(\Delta V_2-\Delta V_1)=Ri\times(Vt_2\times N_2-Vt_1\times N_1)/Rh, \quad (9)$$

$$(\Delta V_2-\Delta V_1)/(Vt_2\times N_2-Vt_1\times N_1)=Ri/Rh. \quad (10)$$

In Eq. (10), $\Delta V_1$, $\Delta V_2$, $Vt_1$, and $Vt_2$ are measured values or may be calculated from measured values, and $N_1$ and $N_2$ are preset values. Therefore, the left side of Eq. (10) is a constant. Accordingly, by determining that one of the internal resistance value Ri of the battery 50 and the resistance value Rh of a single heat generating element 11 be a constant, it is possible to calculate the value of the other of Ri and Rh. It is also possible to calculate the number of dots N from Eq. (1) based on the value thus calculated.

All examples and conditional language provided herein are intended for pedagogical purposes of aiding the reader in understanding the present invention and the concepts contributed by the inventor to further the art, and are not to be construed as limitations to such specifically recited examples and conditions, nor does the organization of such examples in the specification relate to a showing of the superiority or inferiority of the invention. A method of controlling a printer and a printer have been described above in detail based on one or more embodiments of the present invention. It should be understood, however, that various changes, substitutions, and alterations could be made hereto without departing from the spirit and scope of the present invention.

What is claimed is:

1. A method of controlling a printer, comprising:

measuring a first voltage value of a power supply of the printer before energizing a plurality of heat generating elements of a print head of the printer;

calculating, by a controller of the printer, a number (N) of heat generating elements that are simultaneously energizable based on the measured first voltage value of the power supply, an end voltage value of the power supply, an internal resistance value of the power supply, a resistance value of each of the heat generating elements, and a current value of an electric current flowing through a motor of the printer for conveying recording paper; and performing printing on the recording paper by the print head using the heat generating elements of the calculated number (N).

2. The method as claimed in claim 1, further comprises:

calculating, by the controller, a voltage value after a voltage drop of the power supply based on the measured first voltage value of the power supply, the resistance value of each of the heat generating elements, the number (N) of the heat generating elements that are simultaneously energizable, the current value of the electric current flowing through the conveyance motor, and the internal resistance value of the power supply, wherein the printing is performed when the voltage value after the voltage drop is greater than the end voltage value.

3. The method as claimed in claim 1, further comprising:

measuring a second voltage value of the power supply at a time when N heat generating elements are energized; and calculating the current value of the electric current flowing through the conveyance motor based on the measured second voltage value, the measured first voltage value, the internal resistance value of the power supply, and the resistance value of each of the heat generating elements.

4. The method as claimed in claim 1, further comprising:

measuring a second voltage value of the power supply at a time when N heat generating elements are energized; and calculating the internal resistance value of the power supply based on the measured second voltage value, the measured first voltage value, the resistance value of each of the heat generating elements, and the current value of the electric current flowing through the conveyance motor.

5. The method as claimed in claim 1, further comprising:

measuring a second voltage value of the power supply at a time when N heat generating elements are energized; and calculating the resistance value of each of the heat generating elements based on the measured second voltage value, the measured first voltage value, the internal resistance value of the power supply, and the current value of the electric current flowing through the conveyance motor.

6. A method of controlling a printer, comprising:

measuring a voltage value of a power supply of the printer before energizing a plurality of heat generating elements of a print head of the printer;

measuring a first voltage value of the power supply at a time when a first number ($N_1$) of heat generating elements are energized;

measuring a second voltage value of the power supply at a time when a second number ($N_2$) of heat generating elements are energized, the second number ($N_2$) being different from the first number ($N_1$); and calculating, by a controller of the printer, one of an internal resistance value of the power supply and a resistance value of each of the heat generating elements of the print head from the measured voltage value, the measured first voltage value, the first number ($N_1$), the measured second voltage value, the second number ($N_2$), and the other of the internal resistance value and the resistance value.

7. The method as claimed in claim 6, further comprising:

calculating, by the controller, a number (N) of heat generating elements that are simultaneously energizable based on the measured voltage value of the power supply, an end voltage value of the power supply, the internal resistance value of the power supply, the resistance value of each of the heat generating elements of the print head, and a current value of an electric current flowing through a motor of the printer for conveying recording paper; and performing printing on the recording paper by the print head using the heat generating elements of the calculated number (N).

8. A printer, comprising:

a print head that performs printing on recording paper and includes a plurality of heat generating elements;

a motor for conveying the recording paper;

a control part that controls the print head and the conveyance motor; and a voltage measurement part that measures a voltage of a power supply that supplies electric power, wherein the voltage measurement part measures a voltage value of the power supply before energizing the heat generating elements, wherein the control part is configured to calculate a number (N) of heat generating elements that are simultaneously energizable based on the measured voltage value of the power supply, an end voltage value of the power supply, an internal resistance value of the power supply, a resistance value of each of the heat generating elements, and a current value of an electric current flowing through the motor, and wherein the print head performs the printing on the recording paper using the heat generating elements of the calculated number (N).

* * * * *